US005447651A

United States Patent [19]

Karpusiewicz et al.

[11] Patent Number: 5,447,651

[45] Date of Patent: Sep. 5, 1995

[54] PROCESS FOR PRODUCING CONCENTRATED LAUNDRY DETERGENT BY MANUFACTURE OF LOW MOISTURE CONTENT DETERGENT SLURRIES UTILIZING LIQUID ACTIVE SURFACTANT BLEND TECHNOLOGY

[75] Inventors: William M. Karpusiewicz, Washingtonville, N.Y.; Andra J. Vlosky, Teaneck; Feng-Lung G. Hsu, Tenafly; Charles F. Irwin, Randolph; Mark E. Pflugfelder, Bergenfield; all of N.J.

[73] Assignee: Lever Brothers Company, Division of Conopco, Inc., New York, N.Y.

[21] Appl. No.: 169,811

[22] Filed: Dec. 17, 1993

Related U.S. Application Data

[63] Continuation-in-part of Ser. No. 941,995, Sep. 8, 1992, abandoned.

[51] Int. Cl.[6] ..... C11D 1/83; C11D 11/00

[52] U.S. Cl. ..... 252/174; 252/89.1; 252/174.14; 252/174.19; 252/174.21

[58] Field of Search ..... 252/89.1, 174, 174.14, 252/174.19, 174.21

[56] References Cited

U.S. PATENT DOCUMENTS

| | | | |
|---|---|---|---|
| 3,844,969 | 10/1974 | Griffiths et al. | 252/108 |
| 4,000,094 | 12/1976 | Fleming et al. | 252/557 |
| 4,083,813 | 4/1978 | Wise et al. | 252/526 |
| 4,122,044 | 10/1978 | Nakamura et al. | 252/532 |
| 4,129,511 | 12/1978 | Ogoshi et al. | 252/140 |
| 4,180,485 | 12/1979 | Llenado | 252/532 |
| 4,303,556 | 12/1981 | Llenado | 252/527 |
| 4,625,127 | 6/1987 | Kikle et al. | 252/174.17 |
| 4,637,891 | 1/1987 | Delwel et al. | 252/135 |
| 4,738,793 | 4/1988 | Travill | 252/135 |
| 4,826,632 | 5/1989 | Blackburn et al. | 252/550 |
| 4,869,843 | 9/1989 | Saito et al. | 252/135 |
| 4,923,636 | 5/1990 | Blackburn et al. | 252/550 |
| 5,030,379 | 7/1991 | Knight et al. | 252/174.25 |
| 5,045,238 | 9/1991 | Jolicoeur et al. | 252/550 |
| 5,075,041 | 12/1991 | Lutz | 252/540 |
| 5,118,439 | 6/1992 | Urfer et al. | 252/174.17 |

FOREIGN PATENT DOCUMENTS

| | | |
|---|---|---|
| 0088612 | 9/1983 | European Pat. Off. . |
| 0265203 | 4/1988 | European Pat. Off. . |
| 0384070 | 8/1990 | European Pat. Off. . |
| 0448297 | 9/1991 | European Pat. Off. . |
| 2645876 | 10/1990 | France . |
| 1169593 | 11/1969 | United Kingdom . |
| 2053 | 4/1987 | WIPO . |

*Primary Examiner*—Paul Lieberman
*Assistant Examiner*—Michael P. Tierney
*Attorney, Agent, or Firm*—James J. Farrell

[57] ABSTRACT

Detergent powders of high bulk density, containing anionic and nonionic surfactant and builders are prepared by spray-drying a low moisture content slurry containing a prepared or pre-manufactured blend of liquid active surfactants to suspend inorganic solids including selected builders. A viscosity adjuster may be added to improve processability.

13 Claims, No Drawings

PROCESS FOR PRODUCING CONCENTRATED LAUNDRY DETERGENT BY MANUFACTURE OF LOW MOISTURE CONTENT DETERGENT SLURRIES UTILIZING LIQUID ACTIVE SURFACTANT BLEND TECHNOLOGY

This is a continuation-in-part patent application of Ser. No. 07/941,995, filed Sep. 8, 1992 now abandoned.

TECHNICAL FIELD

This invention relates generally to a process for the production of detergent powder by spray-drying.

Traditional mixed active builder containing slurries utilize water as the carrier system for both the active (e.g. surfactant) and solids (e.g. builders such as zeolite, carbonate, and the like). This usually results in high slurry moisture content (i.e. 40–50%).

Liquid active blends on the other hand allow for water and active together to act as a carrier for the solids. The active has changed its function in the slurry. The active instead of being a "solid additive" which must be suspended in the liquid water carrier has itself become part of the liquid carrier system. This change allows for a reduction in the amount of water needed in the slurry as a carrier, because the active substitutes for part of the water.

In the spray-drying process there are frequently opposing factors; for example, more water present in a slurry, requires more evaporation, with a resultant increase in costs. If less water is used to save costs, the slurry becomes correspondingly more viscous until a point is reached at which it cannot be pumped and metered. An additional factor, due to market considerations is that the finished product requires higher quantities of surfactant. Spray-drying, for example, increased quantities and certain types of nonionic surfactant lead to pluming from the spray tower. High temperatures contribute to this pluming. Generally other things being equal, spray-drying of a slurry having a lower water content leads to less heat input in the tower than high water content. It is thus desirable to be able to spray-dry low water content slurries while minimizing the problem of high slurry viscosity. A further advantage is that high density powders may be thus obtained.

U.S. Pat. No. 4,738,793 employs low moisture slurries for spray-drying but this is accomplished using nonionic surfactants in the substantial absence of anionic surfactant (less than 2% anionic is taught).

The current art describes the use of high shear mechanical devices to achieve high powder density (>600 g/L) with zeolite layering to control particle size distribution of the final product U.S. Pat. No. 4,869,843. Also described is use of nonionic surfactant sprayed onto base powder with addition of secondary materials to achieve high powder density (>450 g/L). U.S. Pat. No. 5,030,379 to Knight et al. Specific preparative methods for low water content compositions are disclosed in U.S. Pat. No. 5,075,041.

The methods employed by the art for lowering slurry moisture and avoiding pluming from high temperatures or high nonionic concentrations have not been completely satisfactory.

DEFINITION OF THE INVENTION

A method of slurry preparation and a slurry composition which exhibits exceptionally low viscosity even at low water content, thus enabling it to be spray-dried to a high surfactant concentration without unacceptable pluming has now been discovered. In addition, it has been found that a spray-dried powder of exceptionally high density can be obtained.

Simple mixtures of water and nonionic surfactant, typically result in a very viscous gel. Gel formation may be avoided in producing a liquid active mixture by using a preferred order of addition: water plus caustic, then nonionic plus the acidic form of the anionic surfactant. Water plus caustic changes the characteristic viscosity curve so that when the nonionic is added an emulsion is formed in place of a gel. Emulsion viscosity, of course, is much less than gel viscosity. The acid precursor of the anionic may then be added and is preferably neutralized in situ. This makes the liquid active mixture more viscous, but still avoids the gel state. Once this is done, solids addition of the builder, i.e., zeolite and/or carbonate as well as other builders such as NTA and the like may be carried out.

In U.S. Pat. No. 4,923,636 Blackburn and U.S. Pat. No. 4,826,632 Blackburn, there are disclosed liquid surfactant compositions that can be sprayed onto spray-dried powders to increase the bulk density thereof. While these "densified" spray dried powders have not been produced by mechanical densification, the disadvantages of using a spray dried powder as a starting point remain.

A blend of surfactants may be used such as that disclosed in Hsu et al. Ser. No. 07/808,314 filed Dec. 16, 1991 or 07/816,366 filed Dec. 31, 1991. In the blend, in addition to a neutralized or partially neutralized anionic surfactant, nonionic surfactants are included.

A low moisture content detergent slurry is manufactured utilizing liquid active surfactant blends containing anionic and nonionic surfactants. This low moisture slurry is then spray-dried using standard spray-drying techniques yielding, if desired, a concentrated or high density base powder. Accordingly, the invention provides a process for preparing by spray-drying, washing powders containing anionic active, nonionic active and builder, i.e., carbonate and zeolite, for example, crystalline and/or amorphous aluminosilicate including the zeolites disclosed in EP 384,070A and 448,297A. The builders are used in a proportion of at least about 5 to 50 percent of anionic to 1 to 50 percent of nonionic to 5 to 70 percent of a builder. Preparation of the slurry is comprised of:

A. preparing under agitation a mixture of water, optionally a viscosity adjuster, optionally sufficient alkali metal hydroxide to result in neutralization of the acidic form of desired adjuvants and a prepared surfactant blend containing anionic and nonionic surfactants thus forming an anionic nonionic active mixture, said blend containing about 10% to 80% anionic surfactant, 10% to 80% nonionic surfactant and 0% to 35% water.

B. preferably maintaining the temperature of said mixture below about 200° F.;

C. then adding under sufficient agitation to said anionic-nonionic mixture, sufficient builder and other detergent adjuncts such as sodium silicate, polymer, and the like to result in said powder containing about 5% to 70% of a builder selected from the group consisting of zeolite, carbonate and mixtures thereof. Other builders such as sodium citrate may also be added. This combination of ingredients forms a final slurry mixture having a maximum amount of about 35% water, the minimum amount of water being sufficient to achieve appropriate viscosity;

D. optionally adding a viscosity adjuster, in an amount of from 0 to 50% of said mixture, at any time during the slurry process to result in a viscosity of the final slurry mixture of about 1000 to 20,000 cps measured at a shear rate of 17 to 18 $sec^{-1}$ and a temperature of 150° to 195° F.

E. then adjusting the temperature:, if necessary, of said final mixture to about 135°–195° F. and spray-drying said final mixture to form the base powder;

DESCRIPTION OF THE INVENTION

Preferably the water content will be from 10% to 40% by weight of the slurry, in which case it will be possible to spray-dry the powder to a bulk density above 500 g/liter, desirably from 500 to 900 g/liter. Generally, it will be preferred to reduce the water content to the minimum practical level, although the percentage at which this minimum occurs will vary with the content of the other components of the formulation as explained in more detail below.

Viscosity is extremely important since for ease of operation any composition, e.g. a slurry, must be capable of being sprayed at pressures commonly used such as 10 psi to 1000 psi through nozzle sizes of about 0.1 mm to 11 mm or more at temperatures of about room temperature of about 65° F. up to about 200° F. Such low temperatures avoid excess evaporation. Typically, the viscosity of such compositions is about 1000 centipoise to 20,000 centipoise at a temperature of 150° to 185° F. or even somewhat higher at a shear rate of 17 to 18 $sec^{-1}$.

Compositions having a ratio of anionic surfactant to nonionic surfactant of 1:3 to 3:1 may be employed but 1:2 to 2:1 are of especial interest.

Preferably, the composition or slurry should be formulated so that the viscosity of the final slurry is about 7,000 to 20,000 cps, preferably less than 20,000 centipoise, more preferably less than 10,000 centipoise, measured at a shear rate of 17 to 18 $secs^{-1}$ at a temperature of 150° to 185° F. The slurry must be sufficiently fluid to allow thorough mixing of all of the components in the mixer. After mixing is finished, the slurry must remain sufficiently fluid to pump it out of a mixing vessel to a spray tower. As better and more efficient mixers become available processing of more viscous systems becomes easier. Conversely, as pumps are improved, higher viscosity slurries can be pumped. The viscosity must be such that the desired physical mixing and pumping can be done economically and chemical reactions if any, such as neutralization take place readily. The final point prior to spray-drying is the actual atomization of the slurry in the tower spray nozzles. There are many different designs of spray nozzles well known to those skilled in the art with which to achieve appropriate atomization.

Liquid mixing can be .defined as a Reynolds Number ($N_{Re}$) where $N_{Re}$ is defined as follows:

$$N_{Re} = \frac{ND^2p\,\pi}{\mu}$$

where $N_{Re}$ is Reynolds Number, N is impeller speed, D is impeller diameter, p is specific gravity and $\mu$ is viscosity at a shear rate of $N\pi$ $sec^{-1}$.

In order to provide appropriate impeller mixing, the final slurry in the mixer should have a flow with a Reynolds Number of about 1 to 10,000 which is conveniently produced by an appropriate impeller design.

VISCOSITY ADJUSTERS

The viscosity of the slurry thus depends upon many functional parameters. The viscosity to be achieved must be appropriate for the slurry to be mixed, pumped and atomized in a spray tower. The viscosity thus may vary within fairly wide ranges.

The viscosity of the slurry can be adjusted by the addition of an organic or inorganic additive in a sufficient amount to result in a viscosity in the final slurry of about 1000 to 20,000 cps at a shear rate of 17 to 18 $sec^{-1}$ and a temperature of 150° to 185° F. Examples of viscosity adjusters are nonionic surfactants, hydrotropes (e.g., sodium xylene sulfonate), polyethylene glycol, polypropylene glycol and inorganic salts (e.g., $Na_2SO_4$). This viscosity adjuster may be introduced into the water at the beginning or optionally during the process or may even be added after the anionic precursor but it is preferably added prior to most of the zeolite or other builder solids to insure proper fluidity. The viscosity adjuster may also be put into any of the additives as a mixture and added in this way.

The amount of viscosity adjuster employed is sufficient to insure slurry fluidity and varies from about 0.5% of the slurry weight to about 30% of the slurry weight. It also must be realized that when an anionic sulfated or sulfonated precursor is prepared, a certain amount of free or acidic sulfate will be formed. Due to these impurities in the precursor, some sulfate salt will be present. In normal commercial products, this is usually insufficient to fully fluidize the slurry. Of course, if excess sulfuric or other acid were added intentionally to the precursor, or if the sulfonation or sulfation reaction forming the precursor were terminated prematurely sufficient sulfate or other anion could be introduced with the precursor and the salt formed in situ to fluidize the slurry without adding excess viscosity adjuster.

Temperature during the processing should be carefully controlled. Temperatures of 200° F. or more have destabilized the slurry and degraded the components.

NONIONIC

It is essential to the successful application of the process of the invention that the slurry should contain a nonionic surfactant. Preferably the nonionic surfactant will be an ethoxylated or ethoxylated propoxylated primary or secondary linear or branched chain alcohol having a carbon chain length in the hydrophobic portion of from 5 to 25, and containing from about $3^-$ to about 35 moles of ethylene/oxide and/or propylene oxide per mole of alcohol. Examples of such materials are ethoxylates of the Dobanol and Neodol (Registered Trade Mark) alcohols, sold by Shell Chemicals and the Tergitol (Registered Trade Mark) ethoxylated alcohols sold by Union Carbide Corporation. However, other types of nonionic surfactants can also be used, alkyl phenol ethoxylates for example, including in particular the reaction products of alkylene oxides, usually ethylene oxide, with alkyl ($C_6$-$C_{22}$) phenols, generally $^3-25$ EO, i.e. $^3-25$ units of ethylene oxide per molecule; and products made by condensation of ethylene oxide with the reaction products of propylene oxide and ethylene diamine. Other so-called nonionic surface-actives that may be used include alkyl polyglycosides, long chain tertiary amine oxides, long chain tertiary phosphine oxides and dialkyl sulphoxides.

The amount of Nonionic in the final powder will be about 5 to 50%, preferably 10 to 30%.

ANIONIC

Anionic surfactants which may be formed from precursors (e.g., sulfonic acids) are also essential.

Typical anionic surfactants include sodium alkylbenzene sulphonates, sodium alkyl sulphates, sodium alkane sulphonates and sodium alkyl ether sulphates. More particularly, $C_8$-$C_{24}$ primary and secondary alkyl or alcohol sulfates $C_8$-$C_{24}$ secondary alkane sulfonates, $C_8$-$C_{24}$ olefin sulfonates, $C_{10}$-$C_{22}$ soaps and the like may be employed, preferably, sodium or potassium alkylbenzene sulfonates or alkyl sulfates are employed. Particularly suitable alkylbenzene sulfonates are sodium $C_{11}$-$C_{15}$ alkylbenzene sulfonates. Suitable alkyl sulfates are $C_{11}$-$C_{15}$ alkyl sulfates, although other alkyl sulfates and sulfonates outside this carbon chain length range, may also be used. The acid form of the precursor is neutralized in the mixture with sodium, potassium or ammonium hydroxide.

The amount of anionic in the final powder will be about 5 to 50%, preferably about 10 to 40%.

BLENDS

In addition to the use of individual actives as discussed above and in companion case Ser. No. 07/941,510 filed Sep. 8, 1992 to Karpusiewicz et al. prepared liquid active blends of nonionic and anionic surfactants are used. These blends and methods for their preparation and use are disclosed in U.S. Pat. Nos. 4,637,891; 4,826,632; 4,923,636; 5,045,238; 5,075,041 as well as EP 88,612A and 0,265,203; French Patent 2,645,876 and GB Patent 1,169,594. These blends are preferred with the instant invention, particularly those disclosed in U.S. Pat. Nos. 4,826,632 and 4,923,636 and Ser. Nos. 07/808,314 filed Dec. 16, 1991 and 07/816,366 filed Dec. 31, 1991 to Hsu et al. hereby incorporated by reference herein.

The method of preparation of the blend is important. Simple admixture of normally 50% aqueous neutralized alkylbenzene sulphonate paste and liquid nonionic surfactant in the desired proportions will give not a mobile isotropic liquid but a highly viscous gel which is difficult to handle.

Liquid nonionic surfactant may be gradually added to an alkylbenzene sulphonate paste (neutral salt) which will typically have an active matter content of about 50% by weight. The resulting viscous mixture, containing more than 10% water, is then heated to a sufficiently high temperature for a sufficient period of time for the water content to fall below 10% by evaporation. A clear mobile liquid is obtained and this remains clear and mobile when allowed to cool to ambient temperature.

According to a second method, alkylbenzene sulphonic acid may be mixed with nonionic surfactant, and the mixture treated with concentrated aqueous sodium hydroxide or potassium hydroxide to effect partial or complete neutralization. Mixtures fluid at 20° to 80° C. and containing about 6 to 7% by weight of water may be produced by this method.

According to a variant of the second method, the alkylbenzene sulphonic acid starting material may be in partially neutralized form.

In a third method, a range of compositions containing anionic surfactant, nonionic surfactant and water in relatively high amounts up to about 35% may be prepared containing sodium or potassium hydroxide in excess of that necessary to neutralize the anionic sulfonic acid if a precursor is used. These compositions are sufficiently mobile at temperatures no higher than about 90° C. The blends employed are liquid surfactant compositions mobile at a temperature within the range of about 15° to 90° C. or if the anionic to nonionic ratio is appropriate and the type of nonionic is appropriate even down to about 5° C. This composition contains preferably (a) a sodium or potassium salt of an alkylbenzene sulfonate or alkyl sulfate in an amount not exceeding 80% by weight and preferably 5 to 80% or even 20% to 60% by weight, (b) an ethoxylated nonionic surfactant in an amount not exceeding 80% by weight, preferably 5 to 80% and most preferably 20% to 60% by weight, (c) sodium or potassium hydroxide in an amount of about 2% to 15% by weight, depending on the ratio of anionic to nonionic. For very high anionic to nonionic ratios of 2:1 up to 4:1 a greater excess of caustic is preferred whereas for lower ratios of 0.125:1 smaller excess amounts such as 2% are sufficient, and (d) water in an amount of 0%–35% by weight preferably 5% to 20% by weight most preferably about 10% up to about 20% by weight.

Higher water contents, that is, contents greater than about 10%, when included in a composition of anionic and nonionic surfactants typically result in gel formation even with low ratios of anionic to nonionic such as 0.125:1. The addition of concentrated aqueous hydroxide solution (50 w/w%) prevents gel formation and reduces the viscosity of the composition even though water is added to the composition by the introduction of the aqueous hydroxide solution. The ability to increase the water content of such compositions greatly expands the operation window. The reduction of the viscosity facilitates the ease of operation by improving pumpability and the like.

Viscosity of the blend is extremely important since for ease of operation any composition must be capable of being processed. Typically, the viscosity of such compositions is about 50 centipoise to 5000 centipoise at a temperature of 60° C. or even somewhat higher.

Compositions having a ratio of anionic surfactant to nonionic surfactant of 0.125:1 to 4:1 may be employed but 1:1 to 3:1 are of especial interest.

It has been found that optimal blends of anionic surfactants with selected nonionic surfactants produce very low viscosities and are thus preferred. The nonionic alkyl chain length is preferably somewhat attenuated and less than 12 to 15 carbon atoms, for example, anionic mixtures containing Neodol 1-7, which has an alkyl chain length of $C_{11}$, are surprisingly less viscous than longer alkyl chain nonionics. This is true for various ratios of anionic to nonionic.

In addition, an improvement with regard to the processability properties may be obtained in the blend if 0.5–80% by weight of a $C_8$-$C_{22}$ fatty acid is incorporated in the liquid surfactant composition.

In this case, the blend provides a liquid surfactant composition which is mobile at a temperature within the range of 20° to 80° C. and which comprises a sodium or potassium salt of an alkylbenzene sulphonate or alkyl sulphate in an amount preferably not exceeding 70% by weight; an ethoxylated nonionic surfactant in an amount preferably not exceeding 80% by weight; and water in an amount preferably not exceeding 20% by weight, more preferably not exceeding 10% by weight; characterized in that it further comprises 0.5 to 80% by weight of a fatty acid having 8 to 22 carbon atoms.

According to yet another aspect of the invention, there is provided a process for the manufacture of the above liquid surfactant composition, by mixing said nonionic surfactant with a concentrated aqueous alkali metal hydroxide solution having about 80% to 98% of the stoichiometric amount of said alkali metal hydroxide necessary to neutralize an acid precursor of said sulphate or sulphonate, to form a nonionic alkali dispersion; mixing said acid precursor with said dispersion to form a blend; adjusting the pH to about 7; and then mixing the blend with the fatty acid to form the mobile composition.

The compositions include in addition 0.5–70%, preferably 2–15%, more preferably 2–7% by weight of a fatty acid having 8 to 22 carbon atoms. It is preferred if the fatty acid possesses 12 to 20 carbon atoms, and more in particular 16 to 18 carbon atoms. A suitable fatty acid is coconut fatty acid.

BUILDERS

Selected builder materials are added to the slurry. The builders are preferably zeolite and/or sodium carbonate. Other substantially soluble materials which have a detergency builder action may be used by including them in the slurry. Of course, these builders may be added by post dosing to the composition produced by the spray-drying step. Examples of substantially soluble detergency builders are sodium tripoly-, pyro- and orthophosphates, sodium citrate and various organic detergency builders such as sodium nitrilotriacetate, ODS; TMS/TDS homopolymers of acrylic acid and copolymers of acrylic and maleic acids. Substantially insoluble builders are, for example, sodium aluminosilicates including zeolites, crystalline, amorphous, as well as calcite, and the like. Generally detergency builders will be present in amounts of from 5 to 70% by weight of the final product, amounts of from 25 to 40% by weight being more general.

OTHER DETERGENT ADJUVANTS

The slurries can also contain a number of optional components such as lather controllers, anti-redeposition agents such as sodium carboxymethylcellulose, fabric softening agents such as quaternary ammonium salts either alone or in combination with clays, anti-ashing aids, starches, slurry stabilizers such as homopolymers of acrylic acid and copolymers of acrylic acid and maleic acid; ethylene and maleic anhydride, and of vinyl methyl ether and maleic anhydride, usually in salt form; antioxidants and fluorescers.

In a final process stage the spray-dried powder produced can be dosed with ingredients that are incompatible with the spray-drying process conditions in the amounts required to produce a finished powder. Components may be incompatible for many reasons, including heat sensitivity, pH sensitivity, degradation in aqueous systems and the like. The usual heat-sensitive zwitterionic surfactants such as derivatives of aliphatic quaternary ammonium phosphonium acid, sulphonium compounds in which one of the aliphatic constituents contains an anionic water solubilizing group may be added. Additional components which may be added in this manner are sodium perborate mono- and tetrahydrates, sodium percarbonates and acid bleach precursors such as tetracetylethylene diamine, tetracetylglycouril and sodium nonyl oxybenzene sulphonate, perfumes, enzymes and composite adjuncts. The process is especially suitable for use where it is intended to add composite adjuncts to the spray-dried powder in a dry-dosing step, since such adjuncts normally have very high bulk density and tend to separate from lighter powders. Examples of composite adjuncts are antifoam granules, for instance, granules based on a starch core having a coating of a mixture of liquid and waxy hydrocarbons; composite colored speckles prepared in any way, e.g., containing spray-dried base powder granulated with a colored binder solution; and adjuncts containing calcium carbonate seed crystals such as high surface area calcite (80–90 $m^2g^{-1}$).

The following examples will more fully illustrate the embodiments of this invention. All parts, percentages and proportions referred to herein and in the appended claims are by weight of the total composition unless otherwise stated.

EXAMPLE I

The mixer includes a Lightnin(R) A-320 impeller to promote mixing. 251 lbs. of water is charged into the mixer and heated to 100°–120° F. The agitator is set at 40 RPM. 121 lbs. of 50% caustic solution (enough for the neutralization reactions of precursor alkylbenzene sulfonic acid and citric acid) is added next while maintaining the agitator at about 40 RPM. A temperature rise to 130°–140° F. is observed.

At this point 200 lbs. of nonionic surfactant (in this case, Neodol 25-7, a 7EO nonionic) are pumped into the mixer with the agitation still set at about 40 RPM. The temperature is observed to decrease approximately 10° F. to 120°–130° F. Close to the end of or after the nonionic charge the agitator may be increased to about 50 RPM, 196 lbs. of alkylbenzene sulfonic acid is then added. As the acid neutralizes the temperature increases and the mixture turns from a transparent emulsion to a brown liquid to a white paste. As the mixture reaches the white paste stage, the slurry mixture becomes significantly thicker. It may be necessary to increase the agitation to about 60 RPM during the acid addition in order to promote good mixing and quicker neutralization, a short period of about three minutes after the end of the acid addition is beneficial in order to help ensure full neutralization. The temperature increase from the neutralization reaction is about 30°–40° F. resulting in a slurry temperature of 160°–165° F.

After neutralization 95 lbs. of citric acid (for example, Citrosol(R) 503, a 50% solution) is charged into the mixer. A second neutralization reaction takes place and the temperature rises 10°–20° F. to 175°–185° F. Increasing the agitation to about 70 RPM and a two minute hold time is beneficial after the citric acid addition in order to facilitate mixing and completion of the reaction. 58 lbs. of sodium sulfate, a viscosity adjuster, is added at this point. A few minutes may be necessary for complete mixing of the sodium sulfate. No effective temperature change is observed. 0.16 lbs. of Silicone defoamer is added in order to help remove entrapped air bubbles from the slurry. Removal of entrapped air results in a denser slurry which in turn will result in a denser spray-dried powder. Prior to the zeolite solids addition, the agitator should be increased to about 80 RPM.

At this point 440 lbs. of 4A zeolite is charged into the mixer. The addition of room temperature solids decreases the temperature of the slurry to 155°–165° F. As the solids are mixed, the slurry viscosity increases and it may be necessary to increase agitation to about 90 RPM during zeolite addition or at the end of zeolite addition prior to sodium carbonate addition. 176 lbs. of sodium carbonate are now charged into the mixer. An increase of 5°–10° F. to a slurry temperature of 160°–170° F. is observed as the sodium carbonate hydrates. The slurry appears thinner (i.e. lower viscosity) at this point. 5.1 lbs. of a fluorescent whitener is added next. No temperature increase is observed. Once the whitener is added, the agitation is increased to about 100 RPM and the slurry is heated to a final temperature of 180°–185° F. A final hold time of 5 minutes may be employed to ensure complete mixing of all ingredients. A calculation of Reynolds Number $N_{Re}$ on the final slurry is as follows:

$$N_{Re} = \frac{ND^2 p\,\pi}{\mu}$$

$N$ = impeller speed
$D$ = impeller diameter
$p$ = density (specific gravity)
$\mu$ = viscosity (at $N\pi$ shear rate)

$$N = 100 \text{ RPM} = 1.667 \frac{\text{revolutions}}{\text{sec}} \text{ (rev)}$$

$D$ = 23 inches = 58.42 cm
$p$ = 1400 g/L = 1.4 kg/L $$N\pi = \left(1.667 \frac{\text{rev}}{\text{sec}}\right)\left(3.1416 \frac{1}{\text{rev}}\right) = 5.2 \frac{1}{\text{sec}}$$

$$\mu \cong 36.725 \text{ cP at } 5.2 \frac{1}{\text{sec}}$$

$$\pi = 3.1416$$

$$NRe = \frac{\left[1.667 \frac{\text{rev}}{\text{sec}}\right][58.42 \text{ cm}]^2 \left[\frac{1 \text{ m}}{100 \text{ cm}}\right]^2 \left[\frac{\text{kg}}{1.4 \text{ L}}\right]\left[\frac{1\text{L}}{1 \times 10 - 3m3}\right]\left[3.1416 \frac{1}{\text{rev}}\right]}{[36.725 \text{ cP}]\left[\frac{1 \times 10^{-3} \frac{\text{kg}}{\text{m sec}}}{1 \text{ cP}}\right]}$$

$$N_{Re} = 68$$

Careful temperature control is important since batches which have been heated above 200° F. have been observed to separate and char the nonionic. The slurry described herein may be made, pumped and circulated through piping without physical separation issues provided appropriate temperatures are maintained.

Typical Viscosity profile data from a model slurry as in Example 1 is as follows:

| Shear gate | viscosity (cP) |
|---|---|
| **5.2 | 36,725 |
| 7.615 | 27,270 (T = 159° F.) |
| 11.86 | 19,170 |
| *17.92 | 13,800* |
| 27.49 | 9,858 |
| 42.17 | 6,997 |
| 64.71 | 5,045 |
| 99.26 | 3,637 |

-continued

Typical Viscosity profile data from a model slurry as in Example 1 is as follows:

| Shear gate | viscosity (cP) |
|---|---|
| 152.6 | 2,611 |

*value is typically used for reporting purposes.
**interpolated value

EXAMPLE II

A powder is prepared from the slurry of this invention containing the following ingredients:

FINISHED POWDER PREPARED FROM 30% SLURRY MOISTURE CONTENT (In Order of Addition)

| TOWER: | % IN FINISHED PRODUCT: |
|---|---|
| Water | 12.60 |
| Sodium Hydroxide, 50% soln | —** |
| Alcohol Ethoxylate, 7EO | 12.00* |
| Sodium Alkylbenzene Sulfonate (neutralized from the sulfonic acid) | 12.00* |
| Sodium Citrate (neutralized from citric acid) | 4.00 |
| Silicone Defoamer | 0.01 |
| Zeolite, anhydrous | 22.00 |
| Alcohol Ethoxylate, 11EO | 1.00 |
| Sodium Carbonate | 14.00 |
| Fluorescent Whitening Agent | 0.30 |
| Miscellaneous Solids | 0.02 |
| Reserved (for post-dose ingredients colorants, perfumes, extra builders, and the like) | 22.07 |

*these are the components for the liquid active blend 1:1 Linear alkylbenzene sulfonate (LAS):7EO (Nonionic) to yield 24% active in the finished product.
**consumed in neutralization reactions.

EXAMPLE III

| LOW MOISTURE CONTENT MODEL SLURRY PROCESSING IN ORDER OF ADDITION (1600 lbs., finished product batch size) | | |
|---|---|---|
| RAW | TEMPERATURE AFTER ADDITION COMPLETE | LBS |
| Water | 72 | 285.94 |
| 50% sodium hydroxide | 106 | 122.70 |
| nonionic, 7EO | 101 | 217.60 |
| alkylbenzene sulfonic acid | 146 | 203.50 |
| sodium sulfate | 142 | 141.02 |
| citric acid, 50% | 155 | 95.26 |
| silicone defoamer | 149 | 0.16 |
| 4A zeolite (may have to add heat during zeolite addition in order to maintain −140° F.) | 140 | 440.00 |
| sodium carbonate | 154 | 176.00 |
| fluorescer whitener | 153 | 5.05 |
| Heat finished slurry batch to 185–200° F. | | |

This slurry formulation will yield an approximate Slurry Moisture Content (SMC) of 30%. Water losses due to evaporation may result in a lower SMC measurement. Extra water can be added to compensate.

| LOW MOISTURE CONTENT MODEL SLURRY FINAL FORMULATION | |
|---|---|
| RAW | % FINAL PRODUCT |
| water | 12.6 |
| nonionic, 7EO | 12.5 |
| linear alkylbenzene sulfonate sodium salt (LAS) | 12.5 |
| sodium sulfate | 8.814 |
| sodium citrate | 4.0 |
| silicone defoamer | 0.01 |
| 4A zeolite | 22.0 |
| sodium carbonate | 11.0 |
| fluorescer whitener | 0.3 |
| miscellaneous solids | 0.2018 |
| POST-DOSED | |
| 4A zeolite | 4.0 |
| perfume | 0.4 |
| sodium carbonate | 10.0 |
| speckles | 1.0 |
| enzymes | 0.6742 |
| TOTAL | 100.00 |

EXAMPLE IV

Slurries were prepared as in Example I but the ingredients were varied.

A. LAS/NI 1:1
Slurry Moisture Content 30%
Zeolite**
Sodium Sulfate 8%

In order of Addition

| Component | % Final | % Active | % Water | % Misc. | % Sulf | Total | [lb.] Charge Wt. |
|---|---|---|---|---|---|---|---|
| WATER | 12.6000 | 100.00 | 0.00 | 0.00 | 0.00 | 100.0 | 329.31 |
| Sodium Hydroxide | 0.0000 | 50.00 | 50.00 | 0.00 | 0.00 | 100.0 | 150.91 |
| Nonionic $C_{12-15}$-7EO | 12.5000 | 100.00 | 0.00 | 0.00 | 0.00 | 100.0 | 200.00 |
| (LAS) Anionic Acid | 12.5000 | 96.00 | 0.00 | 2.00 | 2.00 | 100.0 | 195.67 |
| Citric Acid | 4.0000 | 50.00 | 50.00 | 0.00 | 0.00 | 100.0 | 95.26 |
| Sodium Sulfate | 8.0000 | 100.00 | 0.00 | 0.00 | 0.00 | 100.0 | 122.33 |
| Silicone Defoamer | 0.0100 | 100.00 | 0.00 | 0.00 | 0.00 | 100.0 | 0.16 |
| Zeolite | 22.0000 | 90.40 | 9.60 | 0.00 | 0.00 | 100.0 | 389.38 |
| Sodium Carbonate | 11.0000 | 100.00 | 0.00 | 0.00 | 0.00 | 100.0 | 176.00 |
| Fluorescer | 0.3000 | 95.00 | 0.00 | 5.00 | 0.00 | 100.0 | 5.05 |
| HOLE* | *16.4855 | 100.00 | 0.00 | 0.00 | 0.00 | 100.0 | 0.00 |

**zeolite from E. P. 384,070A and 448,297A.

| RAW | COMPOSITION % FINAL POWDER | BASE POWDER |
|---|---|---|
| WATER | 12.6000 | 15.0872 |
| NONIONIC | 12.5000 | 14.9675 |
| LAS | 12.5000 | 14.9675 |
| SODIUM CITRATE | 4.0000 | 4.7896 |
| SODIUM SULFATE | 8.0000 | 9.5792 |
| SILICONE | 0.0100 | 0.0120 |
| ZEOLITE | 22.0000 | 26.3427 |
| SODIUM CARBONATE | 11.0000 | 13.1714 |
| FLUORESCER | 0.3000 | 0.3592 |
| MISC. SOLIDS | 0.6045 | 0.7238 |
| HOLE* | 16.4855 | |
| TOTAL | 100.0000 | 100.0000 |

*to be post dosed

B. LAS/NI 1:1 25% total
Slurry Moisture 30%
Zeolite 4A
Sodium sulfate 4%

In order of Addition

-continued

| Component | % Final | % Active | % Water | % Misc. | % Sulf | Total | [lb.] Charge Wt. |
|---|---|---|---|---|---|---|---|
| WATER | 12.6000 | 100.00 | 0.00 | 0.00 | 0.00 | 100.0 | 251.26 |
| Sodium Hydroxide | 0.0000 | 50.00 | 50.00 | 0.00 | 0.00 | 100.0 | 121.14 |
| Nonionic $C_{12-15}$ 7 E.O. | 12.5000 | 100.00 | 0.00 | 0.00 | 0.00 | 100.0 | 200.00 |
| Sodium Sulfate | 4.0000 | 100.00 | 0.00 | 0.00 | 0.00 | 100.0 | 58.33 |
| LAS Anionic Acid | 12.5000 | 96.00 | 0.00 | 2.00 | 2.00 | 100.0 | 195.67 |
| Citric Acid | 4.0000 | 50.00 | 50.00 | 0.00 | 0.00 | 100.0 | 95.26 |
| Silicone Defoamer | 0.0100 | 100.00 | 0.00 | 0.00 | 0.00 | 100.0 | 0.16 |
| Zeolite 4A | 22.0000 | 80.00 | 20.00 | 0.00 | 0.00 | 100.0 | 440.00 |
| Sodium Carbonate | 11.0000 | 100.00 | 0.00 | 0.00 | 0.00 | 100.0 | 176.00 |
| Fluorescer | 0.3000 | 95.00 | 0.00 | 5.00 | 0.00 | 100.0 | 5.05 |
| HOLE* | 20.4855 | 100.00 | 0.00 | 0.00 | 0.00 | 100.0 | 0.00 |

| RAW | COMPOSITION % FINAL POWDER | BASE POWDER |
|---|---|---|
| WATER | 12.6000 | 15.8462 |
| NONIONIC | 12.5000 | 15.7204 |
| LAS | 12.5000 | 15.7204 |
| SODIUM CITRATE | 4.0000 | 5.0305 |
| SODIUM SULFATE | 4.0000 | 5.0305 |
| SILICONE | 0.0100 | 0.0126 |
| ZEOLITE 4A | 22.0000 | 27.6679 |
| SODIUM CARBONATE | 11.0000 | 13.8340 |
| FLUORESCER | 0.3000 | 0.3773 |
| MISC. SOLIDS | 0.6045 | 0.7602 |
| HOLE* | 20.4855 | |
| TOTAL | 100.0000 | 100.0000 |

*to be post dosed

C. LAS/NI 1:1 35% total
Slurry Moisture Content 25%
Zeolite 4A
Sodium Sulfate 4%

| Component | % Final | % Active | % Water | % Misc. | % Sulf | Total | [lb.] Charge Wt. |
|---|---|---|---|---|---|---|---|
| WATER | 12.6000 | 100.00 | 0.00 | 0.00 | 0.00 | 100.0 | 187.81 |
| Sodium Hydroxide | 0.0000 | 50.00 | 50.00 | 0.00 | 0.00 | 100.0 | 121.14 |
| Nonionic $C_{12-15}$ 7EO | 17.5000 | 100.00 | 0.00 | 0.00 | 0.00 | 100.0 | 280.00 |
| LAS Anionic Acid | 17.5000 | 96.00 | 0.00 | 2.00 | 2.00 | 100.0 | 273.94 |
| Citric Acid | 4.0000 | 50.00 | 50.00 | 0.00 | 0.00 | 100.0 | 95.26 |
| Sodium Sulfate | 4.0000 | 100.00 | 0.00 | 0.00 | 0.00 | 100.0 | 56.06 |
| Silicone Defoamer | 0.0100 | 100.00 | 0.00 | 0.00 | 0.00 | 100.0 | 0.16 |
| Zeolite 4A | 22.0000 | 80.00 | 20.00 | 0.00 | 0.00 | 100.0 | 440.00 |
| Sodium Carbonate | 11.0000 | 100.00 | 0.00 | 0.00 | 0.00 | 100.0 | 176.00 |
| Fluorescer | 0.3000 | 95.00 | 0.00 | 5.00 | 0.00 | 100.0 | 5.05 |
| HOLE* | 10.3244 | 100.00 | 0.00 | 0.00 | 0.00 | 100.0 | 0.00 |

| RAW | COMPOSITION % FINAL POWDER | BASE POWDER |
|---|---|---|
| WATER | 12.6000 | 14.0506 |
| NONIONIC | 17.5000 | 19.5148 |
| LAS | 17.5000 | 19.5148 |
| SODIUM CITRATE | 4.0000 | 4.4605 |
| SODIUM SULFATE | 4.0000 | 4.4605 |
| SILICONE | 0.0100 | 0.0112 |
| ZEOLITE 4A | 22.0000 | 24.5329 |
| SODIUM CARBONATE | 11.0000 | 12.2664 |
| FLUORESCER | 0.3000 | 0.3345 |
| MISC. SOLIDS | 0.7656 | 0.8537 |
| HOLE* | 10.3244 | |
| TOTAL | 100.0000 | 100.0000 |

*to be post dosed

D. LAS/NI 1:1 35%
Slurry Moisture 25%
Zeolite 4A
Sodium Sulfate 8%

-continued

| Component | % Final | % Active | % Water | % Misc. | % Sulf | Total | [lb.] Charge Wt. |
|---|---|---|---|---|---|---|---|
| | In order of Addition | | | | | | |
| WATER | 10.0000 | 100.00 | 0.00 | 0.00 | 0.00 | 100.00 | 209.14 |
| Sodium Hydroxide | 0.0000 | 50.00 | 50.00 | 0.00 | 0.00 | 100.0 | 143.40 |
| Nonionic $C_{12-15}$ 7EO | 17.5000 | 100.00 | 0.00 | 0.00 | 0.00 | 100.0 | 280.00 |
| LAS Anionic Acid | 17.5000 | 96.00 | 0.00 | 2.00 | 2.00 | 100.0 | 273.94 |
| Citric Acid | 4.0000 | 50.00 | 50.00 | 0.00 | 0.00 | 100.0 | 95.26 |
| Sodium Sulfate | 8.0000 | 100.00 | 0.00 | 0.00 | 0.00 | 100.0 | 120.06 |
| Silicone Defoamer | 0.0100 | 100.00 | 0.00 | 0.00 | 0.00 | 100.0 | 0.16 |
| Zeolite 4A | 22.0000 | 80.00 | 20.00 | 0.00 | 0.00 | 100.0 | 440.00 |
| Sodium Carbonate | 11.0000 | 100.00 | 0.00 | 0.00 | 0.00 | 100.0 | 176.00 |
| Fluorescer | 0.3000 | 95.00 | 0.00 | 5.00 | 0.00 | 100.0 | 5.05 |
| HOLE* | 8.9244 | 100.00 | 0.00 | 0.00 | 0.00 | 100.0 | 0.00 |

| RAW | COMPOSITION % FINAL POWDER | BASE POWDER |
|---|---|---|
| WATER | 10.0000 | 10.9799 |
| NONIONIC | 17.5000 | 19.2148 |
| LAS | 17.5000 | 19.2148 |
| SODIUM CITRATE | 4.0000 | 4.3920 |
| SODIUM SULFATE | 8.0000 | 8.7839 |
| SILICONE | 0.0100 | 0.0110 |
| ZEOLITE 4A | 22.0000 | 24.1558 |
| SODIUM CARBONATE | 11.0000 | 12.0779 |
| FLUORESCER | 0.3000 | 0.3294 |
| MISC. SOLIDS | 0.7656 | 0.8406 |
| *HOLE | 8.9244 | |
| TOTAL | 100.0000 | 100.0000 |

*to be post dosed

E. LAS/NI 1:1 40%
Slurry Moisture 20%
Zeolite 4A
Sodium Sulfate 4%

| Component | % Final | % Active | % Water | % Misc. | % Sulf | Total | [lb.] Charge Wt. |
|---|---|---|---|---|---|---|---|
| WATER | 12.6000 | 100.00 | 0.00 | 0.00 | 0.00 | 100.0 | 97.52 |
| Sodium Hydroxide | 0.0000 | 50.00 | 50.00 | 0.00 | 0.00 | 100.0 | 154.53 |
| Nonionic $C_{12-15}$ 7EO | 20.0000 | 100.00 | 0.00 | 0.00 | 0.00 | 1000.0 | 313.08 |
| LAS Anionic Acid | 20.0000 | 96.00 | 0.00 | 2.00 | 2.00 | 100.0 | 313.08 |
| Citric Acid | 4.0000 | 50.00 | 50.00 | 0.00 | 0.00 | 100.0 | 95.26 |
| Sodium Sulfate | 4.0000 | 100.00 | 0.00 | 0.00 | 0.00 | 100.0 | 54.93 |
| Silicone Defoamer | 0.0100 | 100.00 | 0.00 | 0.00 | 0.00 | 100.0 | 0.16 |
| Zeolite 4A | 22.0000 | 80.00 | 20.00 | 0.00 | 0.00 | 100.0 | 440.00 |
| Sodium Carbonate | 11.0000 | 100.00 | 0.00 | 0.00 | 0.00 | 100.0 | 176.00 |
| Fluorescer | 0.3000 | 95.00 | 0.00 | 5.00 | 0.00 | 100.0 | 5.05 |
| HOLE* | 5.2439 | 100.00 | 0.00 | 0.00 | 0.00 | 100.0 | 0.00 |

*to be post dosed

| RAW | COMPOSITION % FINAL POWDER | BASE POWDER |
|---|---|---|
| WATER | 12.6000 | 13.2973 |
| NONIONIC | 20.0000 | 21.1068 |
| LAS | 20.0000 | 21.1068 |
| SODIUM CITRATE | 4.0000 | 4.2214 |
| SODIUM SULFATE | 4.0000 | 4.2214 |
| SILICONE | 0.0100 | 0.0106 |
| ZEOLITE 4A | 22.0000 | 23.2175 |
| SODIUM CARBONATE | 11.0000 | 11.6088 |
| FLUORESCER | 0.3000 | 0.3166 |
| MISC. SOLIDS | 0.8461 | 0.8929 |
| HOLE* | 5.2439 | |
| TOTAL | 100.0000 | 100.0000 |

*to be post dosed

F. LAS/NI 1:1 25% total

-continued

| | |
|---|---|
| Slurry Moisture Content | 30% |
| Zeolite 4A | |
| Sodium Xylene Sulfonate | 1% |

In order of addition:

| Component | % Final | % Active | % Water | % Misc. | % Sulf | Other Name | % Total | [lb] Charge Wt. |
|---|---|---|---|---|---|---|---|---|
| WATER | 12.6000 | 100.00 | 0.00 | 0.00 | 0.00 | | 100.0 | 232.04 |
| SODIUM HYDROXIDE | 0.0000 | 50.00 | 50.00 | 0.00 | 0.00 | | 100.0 | 118.91 |
| NONIONIC ($C_{12-15}$ 7EO) | 12.0000 | 100.00 | 0.00 | 0.00 | 0.00 | | 100.0 | 192.00 |
| LAS ACID | 12.0000 | 96.00 | 0.00 | 2.00 | 2.00 | | 100.0 | 187.85 |
| CITRIC ACID | 4.0000 | 50.00 | 50.00 | 0.00 | 0.00 | | 100.0 | 95.23 |
| SODIUM XYLENE SULFONATE | 1.0000 | 40.00 | 60.00 | 0.00 | 0.00 | | 100.0 | 40.00 |
| SILICONE | 0.0100 | 100.00 | 0.00 | 0.00 | 0.00 | | 100.0 | 0.16 |
| ZEOLITE 4A | 22.0000 | 80.00 | 20.00 | 0.00 | 0.00 | | 100.0 | 440.00 |
| NONIONIC ($C_{12-15}$; 11 E.O.) | 1.0000 | 100.00 | 0.00 | 0.00 | 0.00 | | 100.0 | 16.00 |
| SODIUM CARBONATE | 14.0000 | 100.00 | 0.00 | 0.00 | 0.00 | | 100.0 | 224.00 |
| FLUORESCER | 0.3000 | 95.00 | 0.00 | 5.00 | 0.00 | | 100.0 | 5.05 |
| HOLE* | 21.0742 | 100.00 | 0.00 | 0.00 | 0.00 | | 100.0 | 0.00 |

*to be post dosed.

| Raw | Temp. Pre-Addition | Observations |
|---|---|---|
| Water | 97.8° F. | — |
| Caustic | 97.6° F. | cloudy |
| Neodol 25-7 | 112.1° F. | more cloudy |
| (LAS) Acid | 109.7° F. | like mayonnaise, fluffy |
| Sodium Citrate | 148.5° F. | slightly thinner, still fluffy, like mayonnaise |
| Sodium Xylene Sulfonate | 156° F. | creamier |
| Silicone | 145° F. | no change |
| Zeolite 4A | 145° F. | thick, very slightly moving around the A-320 impeller |
| Nonionic ($C_{12-15}$; 7EO) | 125° F. | Heat up, smooth, slighly moving |
| Sodium Carbonate | 140° F. | thick but mixes in, slight mixing |
| Fluorescer | 154.7° F. | lost moisture, not mixing as well as when sodium carbonate was added, looks thick |

26.7% measured moisture

| RAW | COMPOSITION % FINAL POWDER | BASE POWDER |
|---|---|---|
| WATER | 12.6000 | 15.9644 |
| NONIONIC | 12.0000 | 15.2042 |
| ANIONIC ACID | 12.0000 | 15.2042 |
| SODIUM CITRATE | 4.0000 | 5.0681 |
| SODIUM XYLENE SULFONATE | 1.0000 | 1.2670 |
| SILICONE | 0.0100 | 0.0127 |
| ZEOLITE | 22.0000 | 27.8743 |
| NONIONIC | 1.0000 | 1.2670 |
| SODA ASH | 14.0000 | 17.7382 |
| FLUORESCER | 0.3000 | 0.3801 |
| MISC. SOLIDS | 0.0158 | 0.3801 |
| HOLE* | 21.0742 | |
| TOTAL | 100.0000 | 100.0000 |

*to be post dosed

G. LAS/NI 1:1 — 25% total (Premanufactured and neutralized blend)

| | |
|---|---|
| Slurry Moisture Content | 30% |
| Zeolite 4A | |
| Sodium Sulfate | 4% |

In order of addition:

| Component | % Final | % Active | % Water | % Misc. | % Sulf | % Total | [lb] Charge Wt. |
|---|---|---|---|---|---|---|---|
| WATER | 12.6000 | 100.00 | 0.00 | 0.00 | 0.00 | 100.0 | 252.93 |

-continued

| | | | | | | | |
|---|---|---|---|---|---|---|---|
| BLEND | 25.0000 | 92.00 | 8.00 | 0.00 | 0.00 | 100.0 | 434.78 |
| SODIUM HYDROXIDE | 0.0000 | 50.00 | 50.00 | 0.00 | 0.00 | 100.0 | 65.49 |
| CITRIC ACID | 4.0000 | 50.00 | 50.00 | 0.00 | 0.00 | 100.0 | 95.26 |
| SODIUM SULFATE | 4.0000 | 100.00 | 0.00 | 0.00 | 0.00 | 100.0 | 64.00 |
| SILICONE | 0.0100 | 100.00 | 0.00 | 0.00 | 0.00 | 100.0 | 0.16 |
| ZEOLITE 4A | 22.0000 | 80.00 | 20.00 | 0.00 | 0.00 | 100.0 | 440.00 |
| SODIUM CARBONATE | 11.0000 | 100.00 | 0.00 | 0.00 | 0.00 | 100.0 | 176.00 |
| FLUORESCER | 0.3000 | 95.00 | 0.00 | 5.00 | 0.00 | 100.0 | 5.05 |
| HOLE*/** | 20.8882 | 100.00 | 0.00 | 0.00 | 0.00 | 100.0 | 0.00 |

**to be post dosed.
*BLEND 12.5% Nonionic ($C_{12-15}$, 7EO); LAS 12.5% neutralized

| RAW | COMPOSITION % FINAL POWDER | BASE POWDER |
|---|---|---|
| WATER | 12.60000 | 15.9268 |
| BLEND | 25.0000 | 31.6008 |
| SODIUM CITRATE | 4.0000 | 5.0561 |
| SODIUM SULFATE | 4.0000 | 5.0561 |
| SILICONE | 0.0100 | 0.0126 |
| ZEOLITE | 22.0000 | 27.8087 |
| SODA ASH | 11.0000 | 13.9044 |
| TINOPAL FLUORESCER | 0.3000 | 0.3792 |
| MISC. SOLIDS | 0.2018 | 0.2551 |
| HOLE* | 20.8882 | — |
| TOTAL | 100.0000 | 100.0000 |

*to be post dosed

The compositions of Example I, II, III and IV A through F all use separate mixing of the anionic and nonionic actives.

Example IVG is a prepared neutralized blend. In Examples I, II, III and IV A through F, the surfactant mixtures were prepared as taught herein. Premanufactured or prepared blends either neutralized or not could be employed in place of the individual addition. The blends may be prepared as follows:

LAS: Sodium Salt of $C_{11}$-$C_{15}$ Alkylbenzene sulfonic acid (Stepan trademark Bio-Soft S-100)

NI: Nonionic surfactant ($C_{12}$-$C_{15}$ alcohol ethoxylates), Shell trademark Neodol 25-7

NI3EO: Nonionic surfactant ($C_{12}$-$C_{14}$ alcohol ethoxylates), Shell trademark Neodol 25-3

L: liquid phase

G: gel formation

EXAMPLES V–VII

The neutralized mobile liquidosurfactant mixture listed in Example V is prepared by mixing the nonionic surfactant with the indicated amount of concentrated aqueous sodium hydroxide solution (50 w/w%) and subsequently mixing with alkylbenzene sulfonic acid, Stepan Bio-Soft S-100. Examples V–VII indicate that a higher NaOH content maintains the liquid state for a higher level of water present in the composition The percentages reported in the following Table are based on the final total content of materials.

| | Example V | VI | VII |
|---|---|---|---|
| | (% by weight) | | |
| LAS | 43.0 | 35.3 | 27.5 |
| NI | 43.6 | 35.8 | 27.8 |
| Water | 10.4 | 24.6 | 33.0 |
| NaOH (100%) Excess | 3.0 | 4.3 | 11.7 |

-continued

| | Example V | VI | VII |
|---|---|---|---|
| | (% by weight) | | |
| Phase* | L | L | L |

*at room temperature

EXAMPLES VIII–X

The following liquid surfactant mixtures are prepared by mixing the nonionic surfactant with concentrated aqueous sodium hydroxide solution (50 w/w%) in an amount stoichiometric to the alkylbenzene sulfonic acid plus the excess quantity of NaOH solution. This mixture is then mixed with the alkylbenzene sulfonic acid. The viscosity is measured by a Contraves Rheomat model 108E at room temperature. Examples VIII–X demonstrate the effect of the excess of sodium hydroxide in reducing the viscosity of the surfactant compositions.

| | Example VIII | IX | X |
|---|---|---|---|
| | (% by weight) | | |
| LAS | 57.1 | 54.5 | 52.1 |
| NI | 28.4 | 27.1 | 25.9 |
| Water | 12.1 | 13.8 | 15.4 |
| NaOH (100%) Exceed | 2.4 | 4.6 | 6.6 |
| Shear Rate, 1/sec | 9.85 | 9.85 | 9.85 |
| viscosity, cP | 4120 | 532 | 537 |

EXAMPLES XI–XV

The following mobile liquid surfactant mixtures are prepared by mixing the nonionic surfactant with concentrated aqueous sodium hydroxide solution (50% w/v) in an amount which is slightly less than stoichiometric to the alkylbenzene sulphonic acid, adding the $C_{10}$-$C_{13}$ alkyl benzene sulphonic acid and then a small amount of a 50% (w/v) sodium hydroxide solution to bring the pH to a value of about 8. Due to the exothermic neutralization reaction, the temperature is raised to about 80° C. Finally, the indicated amounts of the fatty acid are added to the mixture.

| | Example | | | | |
|---|---|---|---|---|---|
| | XI | XII | XIII | XIV | XV |
| | (% by weight) | | | | |
| Nonionic.3EO | 21.14 | 20.50 | 19.86 | 19.23 | 18.60 |
| Nonionic.7EO | 21.15 | 20.51 | 19.87 | 19.24 | 18.61 |
| NaOH (50%) | 11.18 | 10.84 | 10.50 | 10.17 | 9.84 |
| ABS (acid) | 45.93 | 44.55 | 43.16 | 41.80 | 40.52 |
| NaOH (50%) | 0.60 | 0.58 | 0.56 | 0.54 | 0.53 |
| $C_{16}$–$C_{18}$ Fatty acid | 0.0 | 3.02 | 6.05 | 9.02 | 12.00 |

The pH of the mixtures of Examples XII–XV was between 5.5 and 7 at a temperature of about 80° C.

EXAMPLE XVI

Tests were run to determine the viscosity effect of blends of lower alkyl chains on the nonionic surfactant in combination with a standard anionic component. The ratios of anionic to nonionic were varied and a standard anionic was used for comparision. The anionic used was alkylbenzene sulfonate. The nonionics used were Neodol 1-7 and Neodol 25-7.

The data follows:

| ANIONIC: NONIONIC BLEND | SHEAR RATE (CONE AND PLATE) | 30° C. | 50° C. | 80° C. |
|---|---|---|---|---|
| 1:2 | | | | |
| 1-7 | 38.4 | 261 | | 17 |
| | 76.8 | | 77 | 17 |
| | Asymptote | 247 | 70 | 17 |
| 25-7 | 38.4 | 398 | 134 | 49 |
| | Asymptote | 367 | 133 | 40 |
| 1:1 | | | | |
| 1-7 | 38.4 | 560 | 156 | 40 |
| | Asymptote | 550 | 148 | 40 |
| 25-7 | 11.5 | 2,930 | 292 | 76 |
| | 38.4 | | 272 | 76 |
| | Asymptote | 1,300 | 260 | 76 |
| 2:1 | | | | |
| 1-7 | 1.9 | | | 16,230 |
| | 19.2 | | | 153 |
| | 38.4 | | | 154 |
| | VISCOMETER CONE AND PLATE | | | |
| 25-7 | 1.9 | | 65,270* | |
| | 38.4 | | | 2,033* |
| | VISCOMETER - (HELIPATH - TO REDUCE IMPACT OF SLIP) | | | |
| 25-7 | 1.7 | | 109,000 | |
| | 2.3 | | | 39,200 |
| | 23 | | | 8,000 |
| | 46 | | | 4,800 |
| | 58 | | 10,280 | |

*Without correction of the Slip Effect

All Viscosities are in cP. Shear rates are in reciprocal seconds. Asymptote indicates Newtonian Plateau at shear rates ≧ 500/s.

The viscosity of the 2:1 with 25-7 mixture was initially run using a Brookfield Cone/Plate Viscometer but the results were low due to slip. The data was run again using a Helipath stand with the Brookfield Viscometer to eliminate channelling. This Helipath reading is thought to be more accurate.

As can be seen by the data, the use of Neodol 1-7 greatly reduces the viscosity under that of Neodol 25-7. In the case of a 2:1 mixture the viscosity is at least an order of magnitude different.

It is understood that the examples and embodiments described herein are for illustrative purposes only and that various modifications or changes in the light thereof will be suggested to persons skilled in the art and are to be included within the spirit and purview of this application and the scope of the appended claims.

What is claimed is:

1. A process for preparing by spray-drying, washing powders consisting essentially of about 5 to 50% anionic active, about 1 to 50% nonionic active selected from the group consisting of (i) an ethoxylated or ethoxylatedpropoxylated primary or secondary linear or branched chain alcohol having a carbon chain length in the hydrophobic portion of from 5 to 25, and containing from about 3 to about 35 moles of ethylene oxide and/or propylene oxide per mole of said alcohol;

(ii) alkyl phenol ethoxylates;

(iii) products made by condensation of ethylene oxide with the reaction products of propylene oxide and ethylene diamine;

(iv) long chain tertiary amine oxides;

(v) long chain tertiary phosphine oxides;

(vi) dialkyl sulfoxides and mixtures thereof;

and about 5 to 70% of builder selected from the group consisting of sodium citrate, zeolite, sodium carbonate and mixtures thereof, optionally an effective amount of detergent adjuvant selected from the group consisting of lather controllers; antiredeposition agents; fabric softening agents; clays; anti-ashing aids; starches; slurry stabilizers selected from the group consisting of homopolymers of acrylic acid and copolymers of acrylic acid and maleic acid, ethylene and maleic anhydride and of vinyl methyl ether and maleic anhydride; antioxidants and fluorescers, and from about 0.5 to 30% of a sole viscosity adjuster selected from the group consisting of sodium xylene sulfonate, polyethylene glycol, polypropylene glycol and sodium sulfate, with the balance being a maximum of 30% water consisting essentially of:

A. preparing under agitation a first mixture of water, and at least sufficient alkali metal hydroxide to result in neutralization of the acidic form of said anionic active;

B. commingling with said first mixture a prepared surfactant blend containing said anionic and said nonionic surfactants to form an anionic-nonionic active mixture, said blend containing about 10% to 80% of said anionic surfactant, 10% to 80% of said nonionic surfactant and 0% to 35% water;

C. maintaining a temperature of said anionic-nonionic mixture below about 200° F.;

D. then adding to said anionic-nonionic active mixture under sufficient agitation sufficient of said builder and other said detergent adjuvants to satisfy the required amount of said builder in said washing powder, thus forming a final slurry mixture, said final mixture having a maximum amount of about 30% of said water;

E. adding to said final slurry mixture said sole viscosity adjuster, to result in a viscosity of the final slurry mixture of about 1000 to 20,000 cps measured at a shear rate of 17 to 18 $sec^{-1}$ and a temperature of 150° F. to 195° F. provided that said viscosity adjuster is added at either step A or step E;

F. then adjusting, if necessary, the temperature of said final mixture to about 135° F. to 195° F. and spray-drying said final slurry mixture.

2. A process as defined in claim 1 having a final slurry viscosity of about 3000 to 20,000 cps at 17 to 18 $sec^{-1}$ at 150°-195° F. in step E.

3. A process according to claim 1 wherein the temperature is controlled between about 50° F. and 200° F.

4. A process according to claim 1 having an anionic to nonionic ratio of about 1:3 to about 3:1.

5. A process according to claim 1 having an anionic to nonionic ratio of about 1:2 to 2:1.

6. A process according to claim 1 having an anionic to nonionic ratio of about 1:1.

7. A process as defined in claim 1 for the continuous manufacture of a particulate detergent composition having a bulk density of at least about 500 g/liter.

8. A process as defined in claim 1 wherein said slurry in step E has a water content of about 10% to about 30%.

9. A process as defined in claim 1 wherein said slurry in step E has a water content of about 20% to about 30%.

10. A process as defined in claim 1 wherein sufficient agitation is achieved with an impeller to insure said final slurry mixture has a flow with a Reynolds number of about 1 to 10,000 in the mixer.

11. A process as defined in claim 1 wherein said builder is a mixture of zeolite and sodium carbonate.

12. A process as defined in claim 1 wherein the nonionic surfactant is a primary alcohol ethoxylate having an alcohol moiety of nine to eleven carbon atoms and an ethoxylation number of 3 to 11.

13. A process as defined in claim 12 wherein the nonionic surfactant is in a ratio of 2 parts anionic to 1 part nonionic.

* * * * *